US011440055B2

(12) United States Patent
Jenkins

(10) Patent No.: US 11,440,055 B2
(45) Date of Patent: Sep. 13, 2022

(54) SYSTEMS AND METHODS FOR SORTING BALLS

(71) Applicant: William Vaughn Jenkins, Atlanta, GA (US)

(72) Inventor: William Vaughn Jenkins, Atlanta, GA (US)

( * ) Notice: Subject to any disclaimer, the term of this patent is extended or adjusted under 35 U.S.C. 154(b) by 0 days.

(21) Appl. No.: 17/112,641

(22) Filed: Dec. 4, 2020

(65) Prior Publication Data

US 2022/0176414 A1 Jun. 9, 2022

(51) Int. Cl.

| | |
|---|---|
| ***B07C 5/34*** | (2006.01) |
| ***A63B 47/00*** | (2006.01) |
| ***B07C 5/36*** | (2006.01) |
| *A63B 102/02* | (2015.01) |

(52) U.S. Cl.

CPC ..... *B07C 5/34* (2013.01); *A63B 47/00* (2013.01); *B07C 5/362* (2013.01); *A63B 2102/02* (2015.10)

(58) Field of Classification Search

CPC ..... B07C 5/34; B07C 5/362; B07C 2501/00; B07C 2501/0018; A63B 47/00; A63B 2102/02; G07F 11/28; G07F 11/24

USPC ..... 209/552; 221/222, 277

See application file for complete search history.

(56) References Cited

U.S. PATENT DOCUMENTS 1,395,391 A 11/1921 Conners
3,411,626 A * 11/1968 Kreamer ..... A63B 47/008 209/640
3,625,052 A 12/1971 Jones
3,627,174 A * 12/1971 Baxendale ..... G07F 11/24 188/82.84
4,555,028 A 11/1985 Solheim
4,576,286 A * 3/1986 Buckley ..... B07C 5/04 209/558
4,896,646 A * 1/1990 Kahelin ..... A63B 47/002 221/277
5,222,391 A 6/1993 Reenstra
5,245,862 A 9/1993 Zeiss
5,277,331 A * 1/1994 Barbaccia ..... A63B 47/002 221/68
5,709,266 A * 1/1998 Kruse ..... B65G 47/1478 221/277
5,760,312 A 6/1998 MacKay
(Continued)

FOREIGN PATENT DOCUMENTS

CN 86204839 U 9/1987
CN 100580422 C 1/2010
(Continued)

*Primary Examiner* — Gene O Crawford
*Assistant Examiner* — Muhammad Awais
(74) *Attorney, Agent, or Firm* — Eversheds Sutherland US (LLP)

(57) ABSTRACT

Embodiments of the disclosure can relate to systems and methods for sorting balls. The systems and methods may involve the use of a ball-feeding mechanism for receiving one or more balls, and feeding the one or more balls to a projection element. The projection element may be located beneath the ball-feeding mechanism such that the balls drop from the ball-feeding mechanism to the projection element, and the balls then project from the projection element to a ball-sorting apparatus. The balls may then subsequently be sorted into a sorting container of one or more sorting containers based on the projected height of the ball.

14 Claims, 7 Drawing Sheets

(56) References Cited

U.S. PATENT DOCUMENTS

| | | | | |
|---|---|---|---|---|
| 6,839,138 | B2 | 1/2005 | Welchman et al. | |
| 7,213,724 | B1 * | 5/2007 | Langer | A63B 69/407 221/258 |
| 7,359,765 | B2 * | 4/2008 | Varvarelis | G07F 17/0092 221/265 |
| 8,809,718 | B1 * | 8/2014 | Doak | B07C 5/363 209/939 |
| 9,821,345 | B2 * | 11/2017 | Sterkel | G01N 3/40 |
| 2010/0065577 | A1 * | 3/2010 | Coughlin | G07F 11/24 221/277 |
| 2014/0260801 | A1 * | 9/2014 | Wellwood | C22B 1/00 209/552 |
| 2015/0375926 | A1 * | 12/2015 | Fischer | B65D 85/62 221/104 |
| 2018/0326263 | A1 * | 11/2018 | Rausch | A63B 47/002 |
| 2019/0299255 | A1 * | 10/2019 | Chaganti | G06V 10/457 |
| 2019/0301261 | A1 * | 10/2019 | Anthony | E21B 33/068 |
| 2020/0225031 | A1 * | 7/2020 | Johnson | A63B 24/0021 |

FOREIGN PATENT DOCUMENTS

| | | | | |
|---|---|---|---|---|
| CN | 204359290 | U | | 5/2015 |
| CN | 106377882 | A | | 2/2017 |
| CN | 108242104 | A | * | 7/2018 |
| EP | 0328855 | A1 | * | 8/1989 |
| FR | 2548807 | A1 | * | 1/1985 |
| FR | 2616566 | A1 | * | 12/1988 |
| KR | 20150005091 | A | * | 1/2015 |
| KR | 20160031356 | A | * | 3/2016 |

* cited by examiner

SYSTEMS AND METHODS FOR SORTING BALLS

FIELD OF THE DISCLOSURE

The disclosure relates to sorting, and in particular, systems and methods for sorting balls.

BACKGROUND

Certain sports involve the use of balls, and such balls may be filled with air or any other type of material. Over a lifetime of a given ball, properties associated with the air included within the ball (for example, air pressure), as well as the properties of the ball itself (for example, the quality of the surface material of the ball), may change, which may consequentially result in a decrease in performance over time of the ball. For example, a decrease in air pressure may result in a ball not being able to bounce as high as a relatively newer ball with a higher associated air pressure. Conventional inspection techniques that may be used to determine the performance levels of balls with varying associated ages may often rely on individual visual inspection or testing by a human tester. As a first example, a human tester may visually inspect a ball to gauge whether any physical deformations on the surface of the ball might decrease the performance of the ball. As a second example, a human tester may bounce the ball on the pavement and use a subjective "feel" to determine if the ball is with an acceptable level of performance. As a third example, the human tester may simply squeeze and/or touch a ball to ascertain its performance level.

SUMMARY OF THE DISCLOSURE

In various embodiments, a system for sorting balls is provided. In various embodiments, the system may include a ball-feeding mechanism for receiving a first ball. In various embodiments, the system may also include a projection element comprising an angled surface, wherein the projection element is located below the ball-feeding mechanism, and wherein the projection element receives the first ball on the angled surface from the ball-feeding mechanism. In various embodiments, the system may also include one or more sorting containers that are separate from the projection element, wherein the one or more sorting containers receive the first ball after it is projected from the angled surface of the projection element.

In various embodiments, the system may further include a ball-sorting apparatus. In various embodiments, the ball-sorting apparatus may include one or more first-type sensors. In various embodiments, the ball-sorting apparatus may also include a sorting element configured to receive the first ball. In various embodiments, the ball-sorting apparatus may also include at least one processor. In various embodiments, the ball-sorting apparatus may also include at least one memory storing computer-executable instructions, that when executed by the at least one processor, cause the at least one processor to determine that a first sensor of the one or more first-type sensors is triggered by the first ball passing by the first sensor, wherein the first sensor is located at a first height. In various embodiments, the computer-executable instructions may cause the system to send, based on the determination that the first height is above the threshold height, an indication to make a first adjustment to the sorting element, wherein making the first adjustment to the sorting element causes the sorting element to deposit the first ball in a first sorting container.

In various embodiments, the sorting element is a tilt table, the first adjustment to the sorting element comprises actuating the tilt table in a first direction, and the first direction is in a direction of the first sorting container.

In various embodiments, the computer-executable instructions further cause the at least one processor to determine that a second sensor of the one or more first-type sensors is triggered, wherein the second sensor is located at a second height. In various embodiments, the computer-executable instructions may cause the system to determine that the second height is below the threshold height. In various embodiments, the computer-executable instructions may cause the system to send, based on the determination that the second sensor is triggered and the determination that the second height is below the threshold height, an indication to make a second adjustment to the sorting element, wherein making the second adjustment causes the sorting element to deposit the first ball in a second sorting container In various embodiments, the ball-sorting apparatus may include one or more second-type sensors, wherein the computer-executable instructions further cause the at least one processor to determine, based on the one or more second-type sensors, data, the data including at least one of: an ambient temperature, a humidity, or an atmospheric pressure. In various embodiments, the computer-executable instructions may cause the system to adjust, based on the data, the threshold height.

In various embodiments, the ball-sorting apparatus may include one or more second-type sensors, wherein the computer-executable instructions further cause the at least one processor to determine, based on the one or more second-type sensors, data, the data including at least one of: an ambient temperature, a humidity, or an atmospheric pressure. In various embodiments, the computer-executable instructions may cause the system to adjust, based on the data, a height of the ball-feeding mechanism relative to the projection element.

In various embodiments, the apparatus may include one or more second-type sensors, wherein the computer-executable instructions further cause the at least one processor to determine, based on the one or more second-type sensors, data, the data including at least one of: an ambient temperature, a humidity, or an atmospheric pressure. In various embodiments, the apparatus may adjust, based on the data, an angle of the angled surface of the projection element.

In various embodiments, an apparatus for sorting balls is provided. In various embodiments, the apparatus may include one or more first-type sensors. In various embodiments, the apparatus may also include a sorting element configured to receive a first ball. In various embodiments, the apparatus may also include at least one processor In various embodiments, the computer-executable instructions may include at least one memory storing computer-executable instructions, that when executed by the at least one processor, cause the at least one processor to determine that a first sensor of the one or more first-type sensors is triggered by the first ball passing by the first sensor, wherein the first sensor is located at a first height. In various embodiments, the computer-executable instructions may also cause the apparatus to determine that the first height is above a threshold height. In various embodiments, the computer-executable instructions may also cause the apparatus to send, based on the determination that the first height is above the threshold height, an indication to make a first adjustment to the sorting element, wherein making the first adjustment to the sorting element causes the sorting element to deposit the first ball in a first sorting container.

In various embodiments, the platform is a tilt table, the sorting element is a tilt table, making the first adjustment to the sorting element comprises actuating the tilt table in a first direction, and the first direction is in a direction of the first sorting container.

In various embodiments, the computer-executable instructions may cause the apparatus to determine that a second sensor of the one or more first-type sensors is triggered, wherein the second sensor is located at a second height. In various embodiments, the computer-executable instructions may also cause the apparatus to determine that the second height is below the threshold height. In various embodiments, the computer-executable instructions may also cause the apparatus to send, based on the determination that the second sensor is triggered and the determination that the second height is below the threshold height, an indication to make a second adjustment to the sorting element, wherein making the second adjustment causes the sorting element to deposit the first ball in a second sorting container.

In various embodiments, the ball-sorting apparatus may include one or more second-type sensors, wherein the computer-executable instructions further cause the at least one processor to determine, based on the one or more second-type sensors, data, the data including at least one of: an ambient temperature, a humidity, or an atmospheric pressure. In various embodiments, the computer-executable instructions may also cause the system to adjust, based on the data, the threshold height.

In various embodiments, the ball-sorting apparatus may include one or more second-type sensors, wherein the computer-executable instructions further cause the at least one processor to determine, based on the one or more second-type sensors, data, the data including at least one of: an ambient temperature, a humidity, or an atmospheric pressure. In various embodiments, the computer-executable instructions may also cause the system to adjust, based on the data, a height of a ball-feeding mechanism relative to a projection element.

In various embodiments, the ball-sorting apparatus may include one or more second-type sensors, wherein the computer-executable instructions further cause the at least one processor to determine, based on the one or more second-type sensors, data, the data including at least one of: an ambient temperature, a humidity, or an atmospheric pressure. In various embodiments, the computer-executable instructions may also cause the system to adjust, based on the data, an angle of the angled surface of a projection element.

In various embodiments, a computer-implemented method is provided. The computer-implemented method may include determining that a first sensor of one or more first-type sensors of a ball-sorting apparatus is triggered by a first ball passing by the first sensor, wherein the first sensor of the ball-sorting apparatus is located at a first height. In various embodiments, the method may also include determining that the first height is above a threshold height. In various embodiments, the method may also include sending, based on the determination that the first height is above the threshold height, an indication to make a first adjustment to a sorting element of the ball-sorting apparatus, wherein making the first adjustment to the sorting element causes the sorting element to deposit the first ball in a first sorting container.

In various embodiments, wherein the sorting element is a tilt table, the method may also include making the first adjustment to the sorting element comprises actuating the tilt table in a first direction, and wherein the first direction is in a direction of the first sorting container.

In various embodiments, the method may also include determining that a second sensor of the one or more first-type sensors is triggered, wherein the second sensor is located at a second height. In various embodiments, the method may also include determining that the second height is below the threshold height. In various embodiments, the method may also include sending, based on the determination that the second sensor is triggered and the determination that the second height is below the threshold height, an indication to make a second adjustment to the sorting element, wherein making the second adjustment causes the sorting element to deposit the first ball in a second sorting container.

In various embodiments, the method may also include determining, based on one or more second-type sensors, data, the data including at least one of: an ambient temperature, a humidity, or an atmospheric pressure. In various embodiments, the method may also include adjusting, based on the data, the threshold height.

In various embodiments, the method may also include determining, based on one or more second-type sensors, data, the data including at least one of: an ambient temperature, a humidity, or an atmospheric pressure. In various embodiments, the method may also include adjusting, based on the data, a height of a ball-feeding mechanism relative to a projection element.

In various embodiments, the method may also include determining, based on one or more second-type sensors, data, the data including at least one of: an ambient temperature, a humidity, or an atmospheric pressure. In various embodiments, the method may also include adjusting, based on the data, an angle of the angled surface of a projection element.

Additional systems, methods, apparatus, features, and aspects are realized through the various embodiments of the disclosure. Other embodiments and aspects of the disclosure are described in detail herein and are considered a part of the claimed subject matter. Other features can be understood and will become apparent with reference to the description and to the drawings.

DETAILED DESCRIPTION

Systems and methods for sorting balls are disclosed. Further, certain embodiments of the disclosure may be directed to systems and methods for sorting balls by dropping the balls from a ball-feeding mechanism onto a projection element with an angled surface. The balls may then project or bounce from the projection element towards a ball-sorting apparatus. Finally, the balls may then be sorted within the ball-sorting apparatus based on their respective bounce heights as they project from the projection element.

Example System and Associated Architecture

Figure 1A:
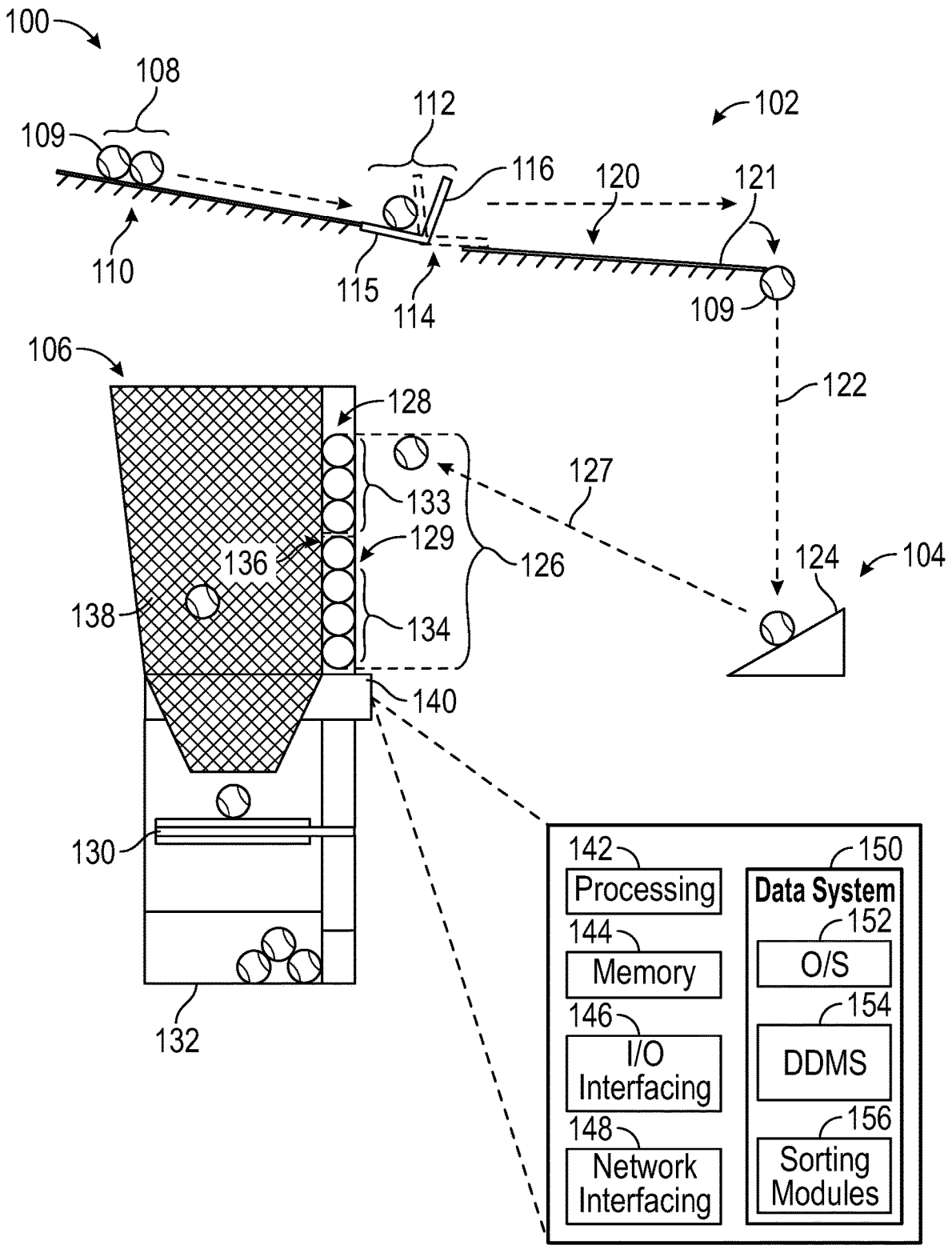
FIG. 1A illustrates an example embodiment of a system, in accordance with at least one embodiment of the disclosure.

FIG. 1A illustrates an example of a system 100 in accordance with at least one embodiment of the disclosure. In some embodiments, the system 100 may be used to determine the quality of one or more balls (and separate balls of differing quality) as described above. In the embodiment shown in FIG. 1A, the system 100 may include at least one ball-feeding mechanism 102, a projection element 104, and a ball-sorting apparatus 106.

In some embodiments, the ball-feeding mechanism 102 may be used to receive one or more balls 108, which may be, for example, tennis balls, or any other balls filled with air or any other material. For simplicity, reference may be made herein to a "first ball 109," but any reference to such may similarly be applied to any of the one or more balls 108 (that is, the first ball 109 may simply refer to an example ball used to track the progression of a ball through the system 100). The ball-feeding mechanism 102 may include a receiving portion 110 that may be used to receive the first ball 109. The receiving portion 110 may be provided at a downward-sloping angle to allow the first ball 109 to travel down the receiving portion 110 without any a user needing to manually interact with the ball for it to progress along the receiving portion 110. However, in some instances, the receiving portion 110 may be configured in a flat orientation (or even an upward-sloping angle) as well. In such a configuration, a mechanism may exist to transport the first ball 109 across the receiving portion 110 (for example, a conveyor belt). The receiving portion 110 may also be configured in any number of other manners. As a first example of such a configuration, the receiving portion may include a hopper with an internal feeder mechanism (for example, similar to a hopper found in a tennis ball machine or a baseball pitching machine).

After traveling over the receiving portion 110, the first ball 109 may encounter a ball management apparatus 112 that may be used to control the rate at which the one or more balls 108 travel across the ball-feeding mechanism 102. For example, the ball management apparatus 112 can receive the first ball 109 (or any other number of balls), and may prevent the first ball 109 from traveling down the ball-feeding mechanism 102 until a triggering input is received. The triggering input may include, for example, a signal from a computing element (such the control system 140 described below), a manual input from a user, and or any other type of input. The triggering input may be provided based on any number of conditions being met, such as a time threshold passing, a determination that a number of balls currently being tested with the system 100 is below a threshold amount, or any other condition. For example, the threshold amount of time may be set to allow sufficient time for one ball to progress through the system 100 and into the one or more sorting containers 132 described below. However, these are merely examples of conditions used to determine when the triggering input is provided, and any other conditions may similarly be employed. The ball management apparatus 112 may further include a holding mechanism 114 for receiving the first ball 109, holding the first ball 109 until the triggering input is received, and subsequently allowing the first ball 109 to continue to travel down the ball-feeding mechanism 102. For example, the holding mechanism 114 may include a first member 115 and a second member 116 that come together at a common vertex to form a V shape, such that the holding mechanism 114 may be tilted towards the receiving portion 110 to receive the first ball 109, may transition to an upright orientation to hold the first ball 109 in place, and may then be tilted away from the receiving portion (for example, as indicated through the dashed lines in FIG. 1A) to allow the first ball 109 to continue traveling down the ball-feeding mechanism 102. The tilting may be performed in any number of ways, such as, for example, through the use of a motor or a servo for actuating the holding mechanism 114.

Figure 1B:
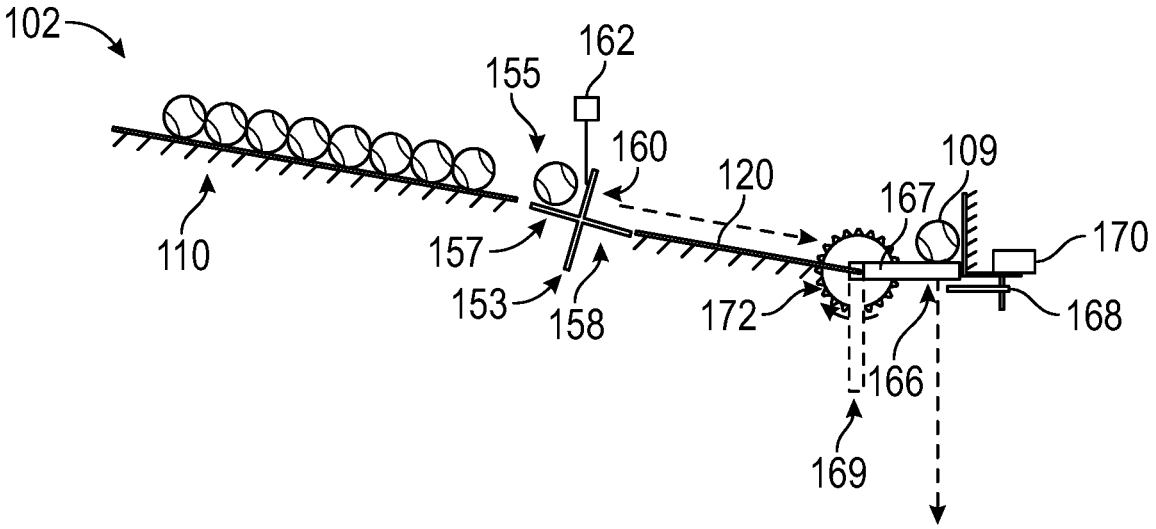
FIG. 1B illustrates an example embodiment of a ball-feeding mechanism portion of the system, in accordance with at least one embodiment of the disclosure.

The above-mentioned configurations(s) of the holding mechanism 114 as described with reference to FIG. 1A should not be taken as limiting, and may only be example configuration(s). Any number of other configurations may be used to control the rate at which balls are able to travel down the ball-feeding mechanism 102. For example, FIG. 1B may depict a second example configuration of the holding mechanism 114. The second example configuration may include a paddle wheel 153. In some instances, the paddle wheel 153 may include a number of open segments for receiving balls, such as open segment 157, open segment 155, open segment 158, and open segment 160. However, in other instances, the paddle wheel 153 may include any other number of open segments. The paddle wheel may be configured to receive the first ball 109 within any of the open segments of the paddle wheel 153 (for example, FIG. 1B depicts the first ball 109 being received within open segment 155). The open segment of the paddle wheel 153 may serve to hold the first ball 109 in place within the paddle wheel 153. The paddle wheel 153 may then perform a rotation (for example in a clockwise direction in the example configuration depicted in FIG. 1B), which may allow the first ball 109 to exit the paddle wheel 153 and travel towards a feeding portion 120 of the ball-feeding mechanism 102 as described below. The second example configuration may also include a sensor 162 for detecting when a ball is located in an open segment of the paddle wheel 153 and ready for loading onto the feeding portion 120. In some instances, the sensor 162 may be in the form of a limit switch. However, the sensor 162 may be any other type of sensor as well, such as a photo cell, ultrasonic sensor, weight sensor, a light beam with a photo cell, or any other type of sensor Additionally, in some instances, the first ball 109 may travel freely down the ball-feeding mechanism 102 without the use of a ball management apparatus 112 or a holding mechanism 114 or similar mechanism for controlling the rate of the flow of the balls.

Returning to FIG. 1A, the ball-feeding mechanism 102 may also contain a feeding portion 120. The feeding portion 120 may be located after the ball management apparatus 112, such that when the holding mechanism 114 is tilted away from the receiving portion 110, the first ball 109 may travel onto the feeding portion 120. The first ball 109 may then travel down the feeding portion 120 until it reaches an end 121 of the feeding portion 120, at which point the first ball may fall off the feeding portion 120 and off the ball-feeding mechanism 102 as a whole. The first ball 109 may then fall into the projection element 104, which may be located underneath the end 121 of the feeding portion 120.

Figure 1C:
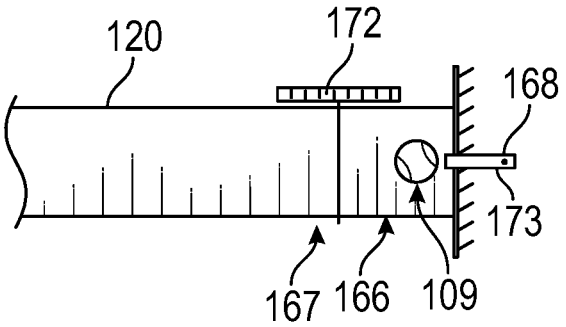
FIG. 1C illustrates a top view of an example embodiment of a feeding portion of a ball-feeding mechanism, in accordance with at least one embodiment of the disclosure.
Figure 1C:
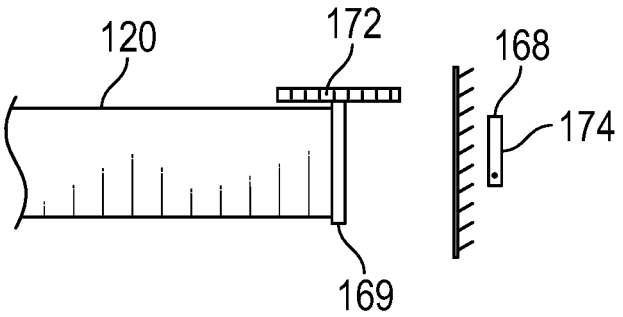

In some embodiments, the feeding portion 120 as depicted in FIG. 1A may also only be one non-limiting example of a feeding portion 120 of the ball-feeding mechanism 102. For example, FIG. 1B, in addition to illustrating a second configuration for the holding mechanism 114, may also illustrate a second example configuration of the feeding portion 120 (as depicted in FIG. 1A). The second example configuration may include a trap door 166 located at or proximal to the end portion of the feeding portion 120. After leaving the paddle wheel 153, the first ball 109 may travel down the feeding portion 120 and stop at the trap door 166. The trap door 166 may be held upright in a first trap door position 167 by a trigger mechanism 168 such that the first ball 109 rests on top of the trap door 166 while the trap door 166 is in the first trap door position 167. For example, the trigger mechanism 168 may be a physical element that in a first orientation (which may be illustrated with respect to FIG. 1C below) may be located underneath the trap door 166, effectively holding the trap door upright 166. In some instances, the trigger mechanism 168 may be connected to a motor 170, such as a servo motor. The motor 170 may serve to rotate the trigger mechanism 168, such that the trigger mechanism 168 moves from the first orientation underneath the trap door 166 to a second orientation in which the trigger mechanism 168 is no longer underneath the trap door 166 (as depicted in FIG. 1C below). Moving the trigger mechanism 168 to the second orientation may allow the trap door 166 to cease being held upright at the first trap door position 167. The trap door 166 may then transition into a second trap door position 169, which may in turn result in the first ball 109 falling from the feeding portion 120 and the ball-feeding mechanism 102. Subsequently, a reset mechanism 172 may be used to return the trap door 166 to the first trap door position 167. In some instances, the reset mechanism 172 may be a gear used to rotate the trap door 166 back to the first trap door position 167. Once the trap door is in the first trap door position 167, the motor 170 may be used to move the trigger mechanism 168 back to the first orientation underneath the trap door 166, which may again hold the trap door 166 in place in the first trap door position 167. FIG. 1C provides a top view of the feeding portion 120 of the second configuration as depicted in FIG. 1B. The top view depicts the trap door 166 in the first trap door position 167 when the trigger mechanism 168 is in the first orientation 173 and the trap door 166 in the second trap door position 169 when the trigger mechanism 168 is in the second orientation 174. It should be noted that the trap door 166 may be held in the first trap door position 167 using any other mechanisms as well, such as a magnet and/or electromagnet, for example. Additionally, the trap door 166 may exist in any other forms as well, such as movable pins that may retract to either side of the feeding portion 120 to allow a ball to fall through.

Figure 1D:
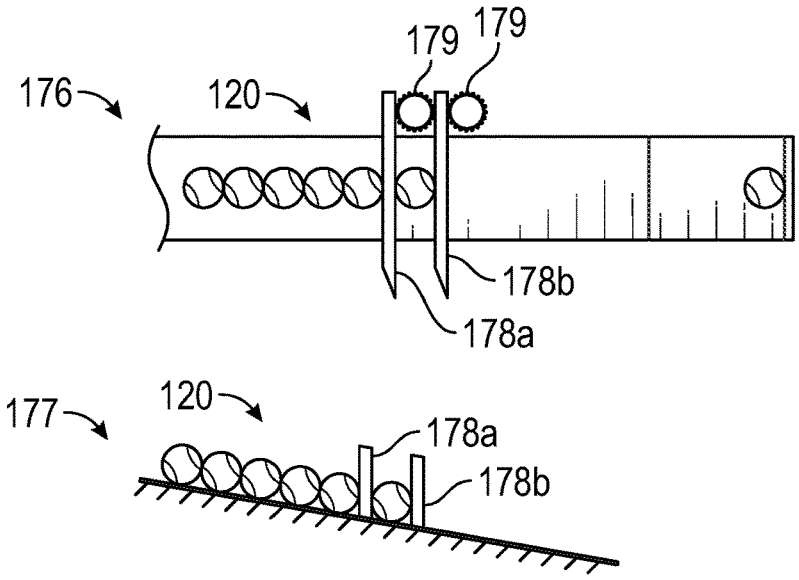
FIGS. 1D-1F illustrate additional example embodiments of a feeding portion of a ball-feeding mechanism, in accordance with at least one embodiment of the disclosure.

FIGS. 1D-1G may provide additional example configurations for the feeding portion 120. FIG. 1D depicts a third example configuration (including, for example, a top view 176 and a side view 177 of the third example configuration). The third example configuration may include moveable slats (for example, slat 178*a*, and/or slat 178*b*, as well as any other number of slats) that may enter into the path of the balls to separate one or more of the balls from one or more of the other balls. The moveable slats may protrude into the feeding portion 120 to prevent the balls from continuing along the feeding portion 120 until the slats are moved out of the path of the balls. The slats may be moved out of and into the path of the feeding portion 120 by using one or more motors 179 (servos or any other mechanism for moving the slats may also be used as well). Additionally, the slats may be moved independently of one another or may be moved in a synchronized manner. For example, slat 178*a* may be moved to allow a single ball to rest again slat 178*b*. Slat 178*b* may then be retracted to allow the ball to travel down the remainder of the feeding portion 120 (for example, to be dropped from the ball feeding-mechanism and provided to a projection element 104 as depicted in FIG. 1A). Subsequently, slat 178*b* may be moved back over the feeding portion 120, and slat 178*a* may retract to allow another ball to come to rest against slat 178*b*, while the remainder of the balls remain behind slat 178*a*. Operating the slats 178*a* and 178*b* in this manner may allow for the ball-feeding mechanism 102 to control the number of balls that are being provided to the projection element 104 at any given time. However, the slats may also be operated in any other suitable manner as well. It should be noted that the slats may also be implemented in the receiving portion 110 of the ball-feeding mechanism 102 or any other portion of the ball-feeding mechanism 102 as well. The same may apply to any of the other embodiments described with respect to FIGS. 1D-1F as well.

Figure 1E:
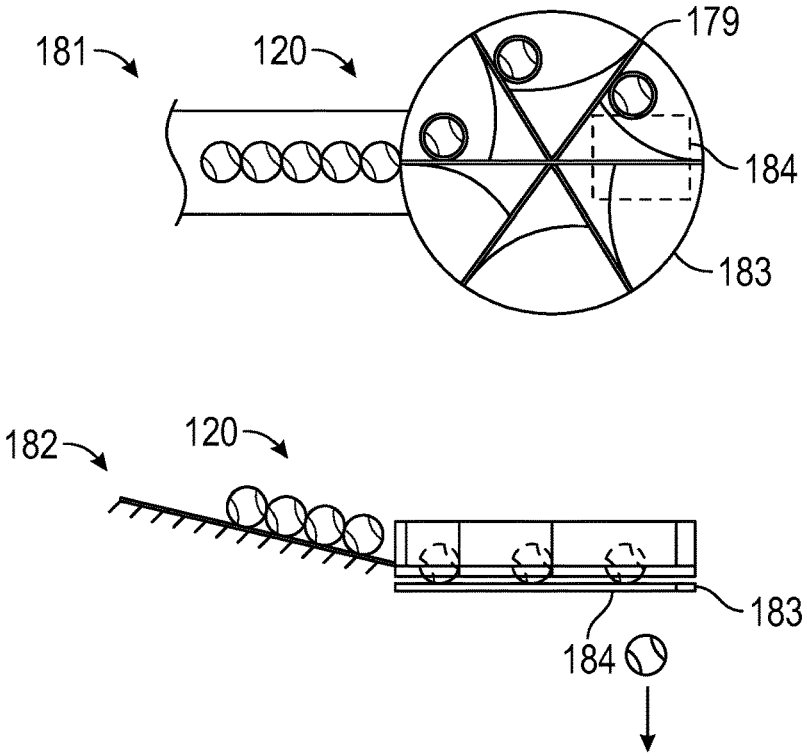

FIG. 1E provides a fourth example configuration of the feeding portion 120 (including, for example, a top view 181 and a side view 182 of the fourth example configuration). The fourth example configuration may include a plate 183 including one or more holes 184. The one or more holes 184 may be sized to allow a ball to pass through, for example. The plate 183 may include a rotating structure 185 that may be used to physically move the balls until they reach the one or more holes 184.

Figure 1F:
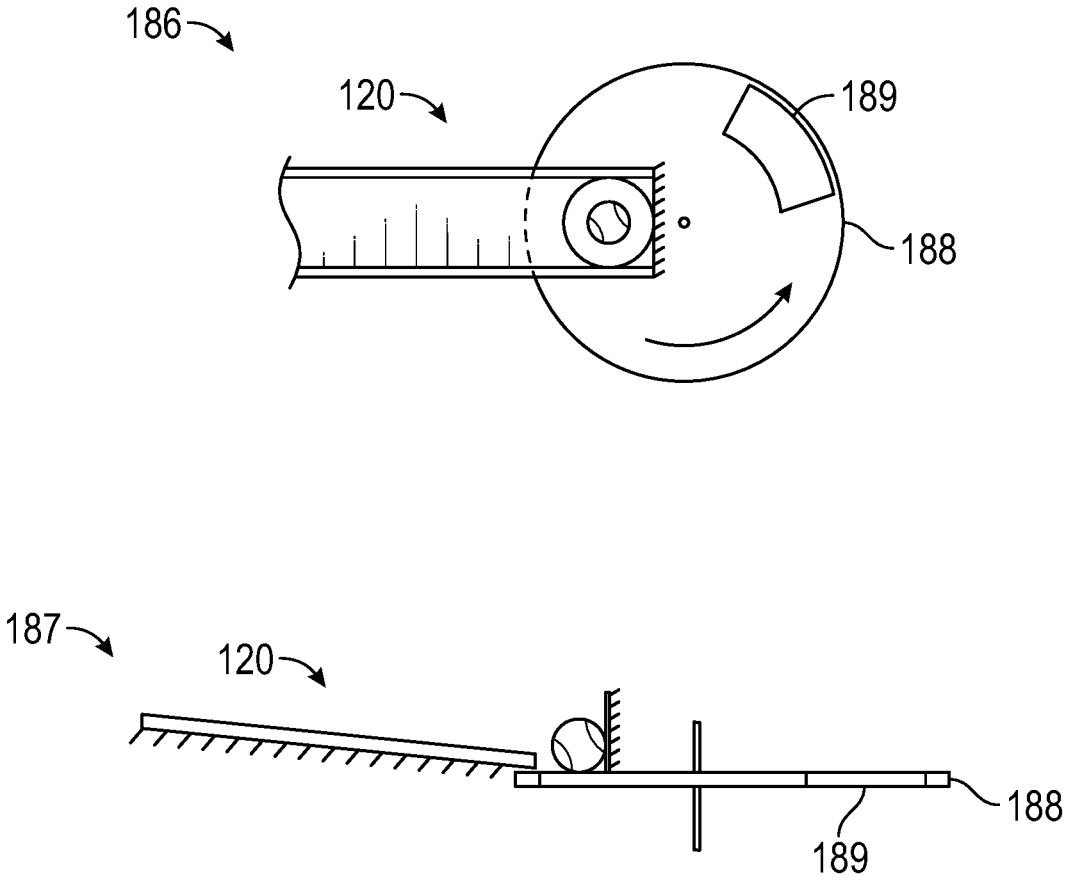

FIG. 1F provides a fifth example configuration of the feeding portion 120 (including, for example, a top view 186 and a side view 187 of the fifth example configuration). The fifth example configuration may include a rotating plate 188 with one or more holes 189 located on the rotating plate 188. The fifth example configuration may be similar to the fourth example configuration, but may only include the rotation plate 188 (that is, the ball may remain stationary, and the rotating plate 188 may rotate the hole 189 to the location of the ball). The ball may roll down the feeding portion 120 onto the top of the rotating plate 188. The ball may remain on the feeding portion 120 until the rotating plate 188 rotates a sufficient amount such that the hole 189 is located at the location of the ball. The ball may then fall through the hole 189 of the rotating plate 188 towards the projection element 104 (not depicted in the figure). It should be noted that although the rotating plate 188 may be depicted as being in line with the angle of the feeding portion 120, the rotating plate 188 may similarly be provided at any other angle as well (for example, the rotating plate 188 may be in line with an imaginary x-axis).

With reference to FIGS. 1A-1F, it should be noted that any combination of any of the elements of the ball-feeding mechanism 102 as described in any of the figures may be used. For example, the trap door 166 as depicted in FIG. 1B may be used in conjunction with the V-shaped ball-holding mechanism 114 shown in FIG. 1A. Additionally, the specific configurations shown in FIGS. 1A-1F (as well as any of the other figures herein) are merely exemplary and should not be limited to any particular configuration depicted in any single figure.

Continuing with FIG. 1A, in some embodiments, the projection element 104 may be an object used to project the ball towards the ball-sorting apparatus 106. To accomplish this, the projection element 104 may be located underneath the ball-feeding mechanism 102, such that when the first ball 109 falls off the feeding portion 120 at the end 121 of the ball-feeding mechanism 102 as described with respect to FIG. 1A, or falls from the trap door 166 as described with respect to FIG. 1B, it may follow a path 122 towards the projection element. The first ball 109 may then project or bounce off the projection element 104 and follow a path 127 of projection towards the ball-sorting apparatus 106. The projection element 104 may include an angled surface 124 from which the first ball 109 may project towards the ball-sorting apparatus 106. The projection element 104 may be constructed from any material that would allow for consistency in the surface from which any of the one or more balls 108 would project from (so the projection surface may be a constant). For example, the project element may be a solid material, a material with a known flexibility property, or any other type of material that may allow a ball to project towards the ball-sorting apparatus in a consistent manner. In this way, it may be ensured that any differences between varying projections paths experienced by different balls are caused by the properties of the balls themselves rather than the projection element 104. Additionally, in some instances, the projection element 104 may be adjustable. For example, an angle of the angled surface 124 may be adjustable, a height or width of the projection element 104 may be adjustable, or any other aspect of the projection element 104 may be adjustable as well.

Continuing with FIG. 1A, in some embodiments, the ball-sorting apparatus 106 may receive the first ball 109 after the first ball 109 is projected from the projection element 104. The ball-sorting apparatus 106 may include one or more first-type sensors 126. The one or more first-type sensors 126 may be located in a projectile path 127 that the first ball 109 may travel through upon projecting from the angled surface 124 of the projection element 104. The first-type sensors 126 may be used to determine a height at which the first ball 109 enters the ball-sorting apparatus 106 after being projected from the projection element 104, and may include any number of different types of sensors. As a first example, the first-type sensors 126 may be proximity sensors or any other type of sensor capable of detecting that the first ball 109 has crossed into a sensing area (for example, 202 depicted in FIG. 2) of the one or more first-type sensors 126. As a second example, the first-type sensors 126 may include photocells that may detect changes in light received from corresponding light sources as the first ball 109 crossed in front of the light source. In some embodiments, the one or more first-type sensors 126 may be configured on the ball-sorting apparatus 106 in a vertical arrangement (for example, as shown in FIG. 1A) such that a first sensor 128 of the first-type sensors 126 may be located above a second sensor 129 of the first type-sensors 126. This vertical arrangement may allow the first-type sensors 126 to determine the projection height of the first ball 109 as the first ball 109 passes by the first-type sensors 126 into the ball-sorting apparatus 106. For example, the first ball 109 may project from the projection element 104 towards the ball-sorting apparatus 106 and may pass by, and thus trigger, the first sensor 128. The triggering of the first sensor 128 may provide an indication that the first ball 109 projected from the projection element 104 to a first height corresponding to the height of the first sensor 128. As another example, the second sensor 129 may be triggered, which may provide an indication that the first ball 109 projected from the projection element 104 to a second height corresponding to the height of the second sensor 129, which may be a much lower height than the first height. In this example, the fact that the first ball 109 triggered the second sensor 129 may indicate that the first ball 109 performs less effectively than a ball that would trigger the first sensor 128 because the first ball 109 was unable to project to the height of the first sensor 128. This may be the case for any number of reasons described herein, such as the first ball 109 having a lower air pressure). This may indicate that the first ball 109 is less useable as a ball for the purpose it is intended for. Additionally, in some cases there may be inconsistencies in the speed at which various balls are traveling when they reach the projection element 104. To account for this, sensors (not shown in the figure) may be placed at various points along the dropping path 122 of the ball to determine the speed of the ball. This speed may impact the projection height and/or distance of the ball. This information may be used in determining which container 132 the ball should be provided to as well. For example, a slower falling ball may trigger a lower sensor even though it may be a quality ball. To account for this, the speed of the slower falling ball may be factored into the storing of the ball.

In some embodiments, the first-type sensors 126 may be provided in any other configuration on the ball-sorting apparatus 106 as well. For example, some or all of the first-type sensors 126 may be provided in a horizontal arrangement in addition to, or alternatively to, providing first-type sensors 126 in a vertical arrangement (as well as any other physical configuration). Including some first-type sensors 126 in a horizontal configuration may allow for depth information about the projection path of a ball to be determined. Thus, the height of the ball at consecutive points in time may be determined. Additionally, the first-type sensors 126 may not necessarily be fixed in one location, but may be adjustable. That is, the positioning of the first-type sensors 126 may be manually adjusted by a user, or may be automatically adjusted by the ball-sorting apparatus 106. For example, the first-type sensors 126 may be automatically adjusted based on data acquired by the control system 140 described below, such as data pertaining to the typical projection path of balls being sorted by the ball-sorting apparatus 106. Additionally, in some embodiments, some or all of the one or more first-type sensors 126 may be provided externally to the ball-sorting apparatus 106 as well. For example, some or all of the first-type sensors may be provided in between the projection element 104 and the ball-sorting apparatus 106 such data pertaining to the projection path 127 of the ball may be captured by the first-type sensors 126 as the ball travels through its projection path 127. This may allow for additional data about the projection path 127 of a ball to be obtained, which may allow for more effective determinations to be made with respect to the performance capabilities of the ball. In some instances, information output by the first-type sensors 126 may be provided to the user in any number of manners. For example, information about the bounce height of the ball and/or the sensors that are triggered (as well as any other types of information) may be displayed to a user through a display (for example, the I/O Interfacing 146) of the control system 140, may be provided to the user through a notification on a mobile device of the user, or through any other methods.

In some embodiments, the ball-sorting apparatus 106 may also include a platform 130 configured to receive the first ball 109. In some instances, after projecting from the projection element 104 and passing by the first-type sensors 126, the first ball 109 may enter the ball-sorting apparatus 106 and may be received by the platform 130. The platform 130 may then be adjusted so as to allow the first ball 109 to be deposited into one or more sorting containers 132. In some embodiments, the platform 130 may be in the form of a tilt-table, which may be a surface that is configured to tilt in any one of multiple directions. For example, the tilt-table may tilt in one direction towards a first container of the one or more sorting containers 132, or may tilt in a second direction towards a second container of the one or more sorting containers 132. Thus, the tilting of the tilting table may determine which container of the one or more sorting containers 132 the first ball is deposited in. In these embodiments, the tilting of the tilt-table may be performed by a motor, servo, or any other similar device capable of tilting the tilt table. The tilt-table may be tilted in a particular direction using any number of different types of actuation mechanism. For example, the tilt-table may be coupled to a servo and/or a motor that may be used to turn the tilt-table in one direction or another. Any other type of actuation mechanism may similarly be used as well.

In some embodiments, the platform 130 may be in any other form that may allow for the ball to be deposited into a single container of the one or more sorting containers 132. For example, the platform 130 may be angled towards a center point, and the center point may contain one or more trap doors that may feed the first ball 109 to one container of the one or more sorting containers 132. This process of sorting balls may be performed on any number of balls simultaneously. Additionally, in some embodiments, a platform 130 may not be included within the ball-sorting apparatus 106. For example, the balls may instead be directed down a chute or track and then may be diverted them into different sorting containers 132 using jets of compressed air. The balls may also be diverted into different sorting containers using diverting paddles that extend out into the path of the ball, trap doors that open in the path of the ball, or by adjusting a portion of the chute itself to direct the ball into one or more containers. As another example, high pressure air may be used to divert the ball trajectory after the ball has passed through a sensing window (for example, passed through a location including the one or more first-type sensors 126) but before the ball has landed in a sorting container 132. The manner in which the high-pressure air is provided to direct the path of the ball into a particular sorting container 132 may be based on data received from the one or more first-type sensors 126 (for example, data pertaining to the path of the ball).

In some embodiments, the depositing of the first ball 109 into an individual container of the one or more sorting containers 132 may be performed based on which first-type sensor (e.g., 128 or 129) was triggered as the first ball 109 passed by the one or more first-type sensors 126 into the ball-sorting apparatus 106. For example, if the first ball 109 passed by the first sensor 128 of the first-type sensors 126, then the platform 130 may be adjusted to deposit the first ball 109 in a first container of the one or more sorting containers 132. In another example, if the first ball 109 passed by the second sensor 129 of the first-type sensors 126, then the platform 130 may be adjusted to deposit the first ball 109 in a second container of the one or more sorting containers 132. In the embodiments where the platform 130 is a tilt table, for example, the tilt table may be tilted in one direction when the first sensor 128 is triggered and the tilt table may be tilted in another direction when the second sensor 129 is triggered. These directions may correspond to the first and second containers respectively.

In some instances, the adjustment of the platform 130 may not be based on which individual first-type sensor 126 is triggered, but rather may be based on whether any first-type sensor 126 of a particular set of first-type sensors 126 is triggered. For example, the first-type sensors 126 may be split into multiple sets of first-type sensors 126. The sets may include a first set 133 and a second set 134, and the first and second set may be determined based on a threshold height 136 that is used to separate the first set 133 and second set 134. However, any number of sets of first-type sensors 126 and thresholds may be possible. In such instances, the different sets of first-type sensors 126 may be associated with a particular container of the one or more sorting containers 132. For example, the first set 133 may be associated with the first container, the second set 134 may be associated with the second container, a third set may be associated with a third container, and so on. This may allow the ball-sorting apparatus 106 to determine that the first ball 109 either has or has not surpassed a particular threshold height, and thus is able to sort the first ball 109 based on how well it is able to bounce (e.g., project from the projection element 104).

Figure 2:
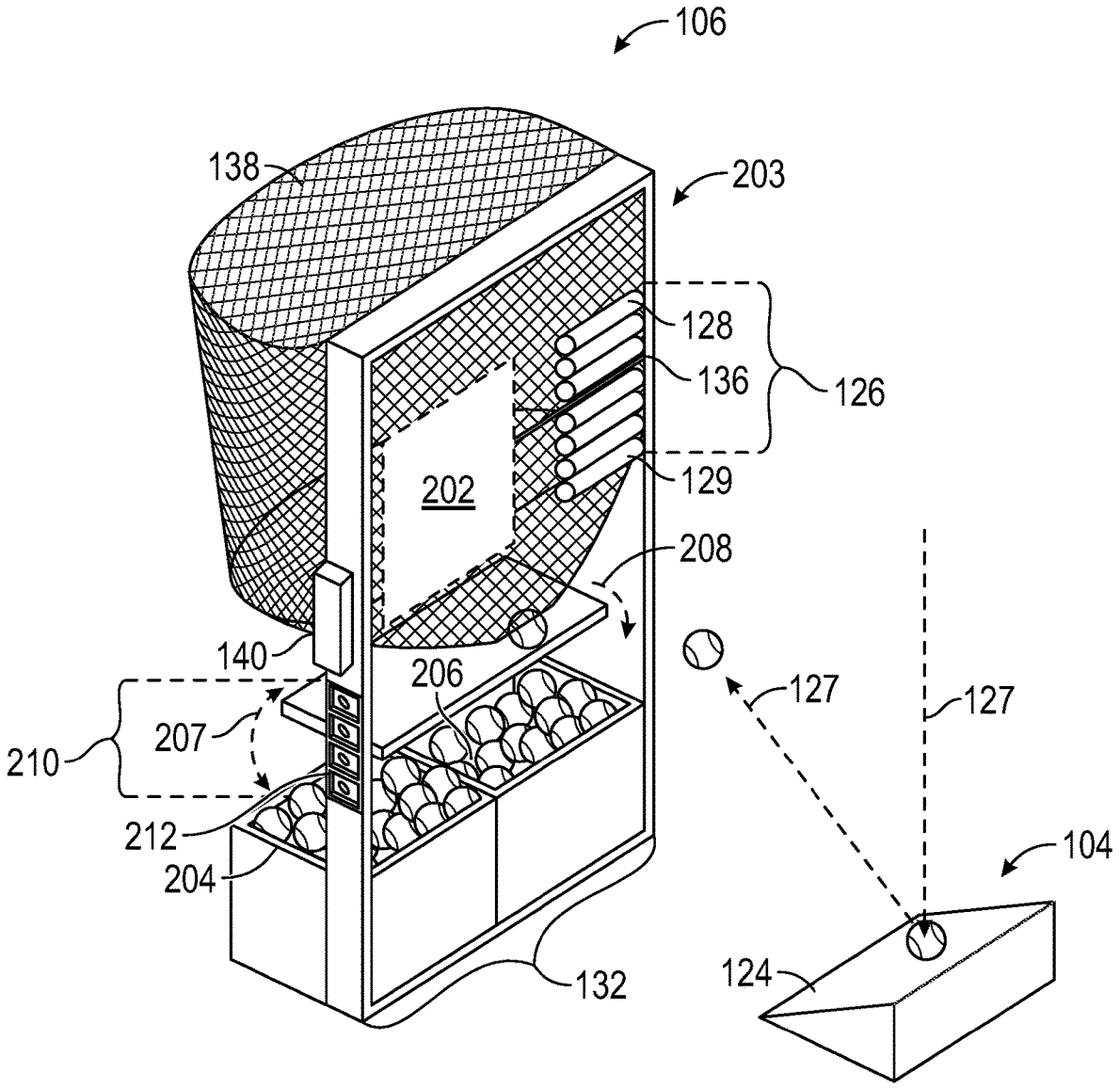
FIG. 2 illustrates a perspective view of the example system, in accordance with at least one embodiment of the disclosure.

In some embodiments, the ball-sorting apparatus 106 may also include a ball-catching element 138. In some embodiments, ball-catching element 138 may be affixed to the ball-sorting apparatus 106, and may serve to catch the first ball 109 after being projected from the projection element 104, and may further serve to direct the first ball 109 towards the platform 130 for sorting in one of the one or more sorting containers 132. In some instances (as is depicted in FIGS. 1 and 2), the ball-catching element 138 may be in the form of a net. However, in some embodiments, the ball-catching element 138 may be replaced by any number of other structures for stopping and directing the first ball 109 to the platform 130. For example, the ball-catching element 138 may be a solid housing structure made of, for example, plastic. Additionally, in some instances, the ball-catching element 138 may include a funneling element. For example, the funneling element may include a wider top portion for receiving the ball as it enters the ball-sorting apparatus 106, and a more narrow portion for depositing the ball on the platform 130.

In some embodiments, the ball-sorting apparatus may also include one or more second-type sensors (not shown in the figure). However, it should be noted that the second-type sensors may also be located anywhere else in the system 100, such as at the ball-feeding mechanism 102, or at the projection element 104, for example. The one or more second-type sensors may include, for example, temperature sensors, as well as any other type of sensors, such as sensors for measuring atmospheric pressure and humidity. The one or more second-type sensors may be used to determine the one or more parameters associated with the system 100 and/or the environment in which the system 100 is located. Such parameters may include, for example, ambient temperature of the environment in which the system 100 is located, atmospheric pressure, humidity, or any number of other parameters. Based on the determined parameter, the system 100 may be adjusted accordingly. In some instances, the height threshold 136 may be adjusted. In such instances, the height threshold 136 may be increased or decreased to include more or less first-type sensors 126 above the threshold line. For example, the height threshold 136 may be increased when the ambient temperature is determined to be higher and may be decreased when the ambient temperature is lower. In some instances, the angle of the angled surface of the projection element 104 may be increased or decreased. In some instances, the height of the ball-feeding mechanism 102 relative to the projection element 104 may also be increased or decreased. For example, the height may be increased when the ambient temperature is lower and may be decreased when the ambient temperature is higher. These adjustments may be performed because the ambient temperature may impact bouncing capabilities of the first ball 109. For example, the first ball 109 may not be able to bounce as high or far if the ambient temperature is lower. Thus, the system 100 can be adjusted to account for such differences in bouncing capabilities in different ambient temperatures. As another example, the height of a sensor window (for example, a location of the one or more first-type sensors 126 might also be adjusted in any number of different directions. As another example, the positioning of elements of the system 100 may be adjusted relative to one another. For example, the physical positioning of the ball-sorting apparatus 106 may be adjusted. Additionally, these example adjustments described above, as well as any other adjustments, may be similarly applied to any of the other embodiments described herein (for example, with respect to at least FIG. 3 below). It should be noted that the above-mentioned adjustments are not intended to be limiting, and any other adjustments may similarly be performed.

In some embodiments, the ball-sorting apparatus 106 may also include a control system 140. The control system may include at least one or more processors 142, memory 144, one or more input/output (I/O) interfaces 146, one or more network interfaces 148, and data storage 150. The one or more input/output (I/O) interfaces 146 may allow a user to provide input commands to the control 140 system (for example, through a keyboard and mouse, touchscreen, or the like). The one or more input/output (I/O) interfaces 146 may also allow the control system 140 to display information to a user, such as information relating to any data produced by any of the sensors described herein, for example. Other examples of information that may be displayed may include a number of balls in each of the sorting containers 132, certain operating parameters of the system 100, such as any thresholds being used, the status of individual elements in the system 100, among any other types of information that may possible be displayed to a user. The one or more processor(s) 142 that may include any suitable processing unit capable of accepting digital data as input, processing the input data based on stored computer-executable instructions, and generating output data. The computer-executable instructions may be stored, for example, in the data storage 150 and may include, among other things, operating system software and application software. The computer-executable instructions may be retrieved from the data storage 150 and loaded into the memory 144 as needed for execution. The processor 142 may be configured to execute the computer-executable instructions to cause various operations to be performed. Each processor 142 may include any type of processing unit including, but not limited to, a central processing unit, a microprocessor, a microcontroller, a Reduced Instruction Set Computer (RISC) microprocessor, a Complex Instruction Set Computer (CISC) microprocessor, an Application Specific Integrated Circuit (ASIC), a System-on-a-Chip (SoC), a field-programmable gate array (FPGA), and so forth.

The data storage 150 may store program instructions that are loadable and executable by the processors 142, as well as data manipulated and generated by one or more of the processors 142 during execution of the program instructions. The program instructions may be loaded into the memory 144 as needed for execution. Depending on the configuration and implementation of the control system 140 the memory 144 may be volatile memory (memory that is not configured to retain stored information when not supplied with power) such as random access memory (RAM) and/or non-volatile memory (memory that is configured to retain stored information even when not supplied with power) such as read-only memory (ROM), flash memory, and so forth. In various implementations, the memory 144 may include multiple different types of memory, such as various forms of static random access memory (SRAM), various forms of dynamic random access memory (DRAM), unalterable ROM, and/or writeable variants of ROM such as electrically erasable programmable read-only memory (EEPROM), flash memory, and so forth.

Various program modules, applications, or the like may be stored in data storage 150 that may comprise computer-executable instructions that when executed by one or more of the processors 142 cause various operations to be performed. The memory 144 may have loaded from the data storage 150 one or more operating systems (O/S) 152 that may provide an interface between other application software (e.g., dedicated applications, a browser application, a web-based application, a distributed client-server application, etc.) executing on the control system 140 and the hardware resources of the control system 140. More specifically, the 0/S 152 may include a set of computer-executable instructions for managing the hardware resources of the control system 140 and for providing common services to other application programs (e.g., managing memory allocation among various application programs). The O/S 152 may include any operating system now known or which may be developed in the future including, but not limited to, any mobile operating system, desktop or laptop operating system, mainframe operating system, or any other proprietary or open-source operating system.

The data storage 150 may additionally include various other program modules that may include computer-executable instructions for supporting a variety of associated functionality. For example, the data storage 150 may include one or more applications, including one or more sorting modules 156. In the embodiment shown, a sorting module 156 can include computer-executable instructions that in response to execution by one or more processors 142 cause operations to be performed including determining that a first ball triggers a first sensor of one or more first-type sensors, wherein the first sensor is located at a first height. The operations may also include determining that the first height is above a threshold height. The operations may also include sending, based on the determination that the first height is above the threshold height, an indication to make a first adjustment to a platform, wherein making the first adjustment allows the first ball to be deposited into a first sorting container of the one or more sorting containers. Any other operations described herein may be included as well.

The data storage 150 may further include one or more database management systems (DBMS) 154 for accessing, retrieving, storing, and/or manipulating data stored in one or more datastores. The DBMS 154 may use any of a variety of database models (e.g., relational model, object model, etc.) and may support any of a variety of query languages.

Those of skill in the art will appreciate that any of the components of the system 100 and associated architecture may include alternate and/or additional hardware, software, or firmware components beyond those described or depicted without departing from the scope of the disclosure. More particularly, it should be appreciated that hardware, software, or firmware components depicted or described as forming part of any of the illustrative components of the system 100, and the associated functionality that such components support, are merely illustrative and that some components may not be present or additional components may be provided in various embodiments. While various program modules have been depicted and described with respect to various illustrative components of the system 100, it should be appreciated that the functionality described as being supported by the program modules may be enabled by any combination of hardware, software, and/or firmware. It should further be appreciated that each of the above-mentioned modules may, in various embodiments, represent a logical partitioning of supported functionality. This logical partitioning is depicted for ease of explanation of the functionality and may not be representative of the structure of hardware, software, and/or firmware for implementing the functionality. Accordingly, it should be appreciated that the functionality described as being provided by a particular module may, in various embodiments, be provided at least in part by one or more other modules. Further, one or more depicted modules may not be present in certain embodiments, while in other embodiments, additional modules not depicted may be present and may support at least a portion of the described functionality and/or additional functionality. Further, while certain modules may be depicted and described as sub-modules of another module, in certain embodiments, such modules may be provided as independent modules.

Those of skill in the art will appreciate that the illustrative system 100 is provided by way of example only. Numerous other operating environments, system architectures, and device configurations are within the scope of this disclosure. Other embodiments of the disclosure may include fewer or greater numbers of components and/or devices and may incorporate some or all of the functionality described with respect to the illustrative system 100, or additional functionality.

FIG. 2 illustrates an example of the system in accordance with at least one embodiment of the disclosure. In some instances, FIG. 2 may illustrate the system of FIG. 1 in a perspective view. The perspective view shows different elements of the ball-sorting apparatus 106 that might not be visible in FIG. 1. For example, FIG. 2 may show an example configuration of the first-type sensors 126 of the ball-sorting apparatus 106. As depicted, the first-type sensors 126 may be located in a vertical arrangement on one side of the ball-sorting apparatus 106. However, this is not intended to be limiting, and the first-type sensors may be located anywhere on the ball-sorting apparatus 106. The first-type sensors 126 may be positioned such that they are able to detect (are triggered) when the first ball 109 crosses through a sensing area 202 located in the proximity of the first-type sensors 126. The sensing area 202 may be large enough so that any of the one or more balls 108 that pass into the ball-sorting apparatus 106 would cross through the sensing area 202. It should be noted that although FIG. 2 depicts a specific open space in the ball-catching element 138 as the sensing area 202, this may merely be for illustration purposes, and the ball-catching element 138 may be included on the ball-sorting apparatus 106 in any number of other configurations. For example, the ball-catching element 138 may be removed from the entire front side 203 of the ball-sorting apparatus 106. That is, the depiction of the size and/or shape of the sensing area 202 is not necessarily limited to the depiction in FIG. 2, but may also be any other size and/or shape as well.

FIG. 2 also shows a perspective view of the individual containers of the one or more sorting containers 132. For example, the one or more sorting containers 132 may include a first sorting container 204 and a second sorting container 206. Also depicted may be the platform 130 in the form of the example tilt table (as aforementioned, however, the platform may be in any number of various forms). In this example embodiment, the platform 130 may tilt in a first direction 207 towards the first sorting container 204, and may also tilt in a second direction 208 towards the second sorting container 206. As mentioned previously, the direction of the tilt may be performed based on the particular sensor or sensors of the first-type sensors 126 that are triggered when the first ball 109 crossed through the sensing area 202. For example, the platform 130 may tilt in the first direction 207 when the first sensor 128 of the first set 133 of first-type sensors 126 is triggered (e.g., the first ball crossed through the sensing area 202 in the proximity of the first sensor 128). Thus, balls that cross the sensing area 202 above the height threshold 136 may be sorted into the first container 204. As mentioned with respect to FIG. 1, the platform 130 may be in any other form that allows for the ball to be deposited into a single container of the one or more sorting containers 132. For example, the platform 130 may be angled towards a center point, and the center point may contain one or more trap doors that would feed the first ball 109 to one container of the one or more sorting containers 132. This process of sorting balls may be performed on any number of balls simultaneously.

In some embodiments, the ball-sorting apparatus 106 may also contain a set of indicators 210 used to display an indication as to which of the first-type sensors are triggered when the first ball 109 crosses through the sensing area 202. For example, a first indicator 212 of the indicators 210 may provide an indication when the first sensor 128 of the first-type sensors 126 is triggered. The indicators may be in the form of LEDs, speakers, or any other devices capable of providing an indication, such as a visual or auditory indication.

Figure 3:
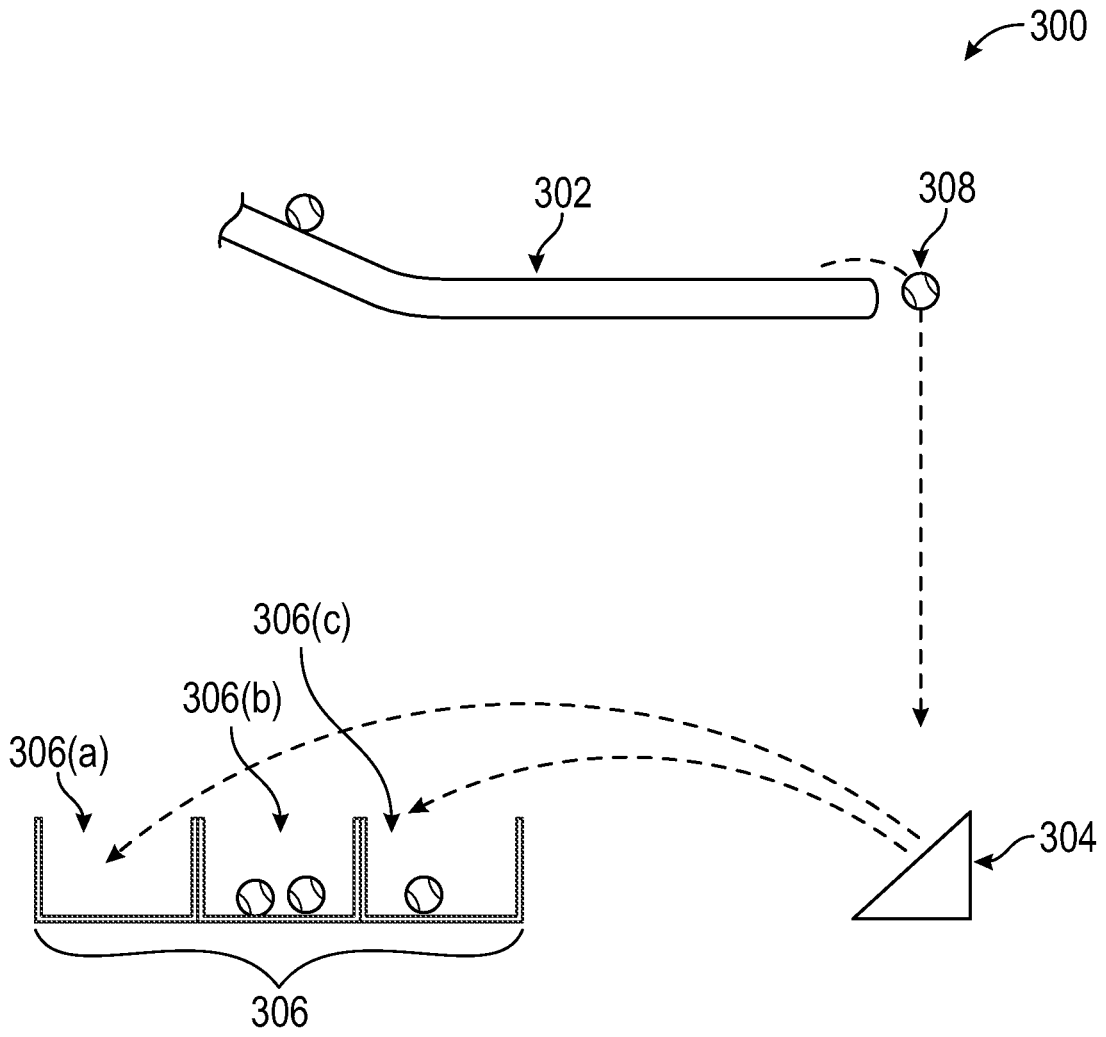
FIG. 3 illustrates another example embodiment of a system, in accordance with at least one embodiment of the disclosure.

FIG. 3 illustrates an example system 300 architecture in accordance with at least one embodiment of the disclosure. Example system 300 may be another example embodiment of the ball sorting system (for example, may be a more simplistic configuration of the system 100 and/or 200 depicted in FIGS. 1A-1C and FIG. 2). In some instances, example system 300 may include a ball-feeding mechanism 302, a projection element 304, and one or more sorting containers 306, where the one or more sorting containers 306 includes any number of sorting containers, such as, for example, sorting containers 306(*a*), 306(*b*), and/or 306(*c*). The ball-feeding mechanism 302 and projection element 304 may be the same as the ball-feeding mechanism 102 and the projection element 104 with respect to example system 100. Example system architecture 300 may differ from example systems 100 and 200 in that the ball-sorting apparatus 106 is replaced by the one or more sorting containers 306. In some instances, the example system 300 functions in much the same way as the example systems 100 and 200. The ball-feeding mechanism 302 may feed a ball 308, and the ball 308 may then drop from a height onto the projection element 304. The ball may then bounce off the projection element 304 and project into one of the sorting containers 306 depending on the air pressure or other properties of the ball 308. Thus, balls of higher quality (e.g., balls that are capable of bouncing higher because they have higher air pressure) may project from the projection element 304 into a sorting container that is a greater distance away from the projection element 304 (for example, sorting container 306 (*a*)). This more simplified system 300 may be beneficial in that it may allow for a larger volume of balls to be sorted at a more rapid rate than the example systems 100 and 200. However, all example systems disclosed herein may be capable of sorting multiple balls simultaneously.

Figure 4:
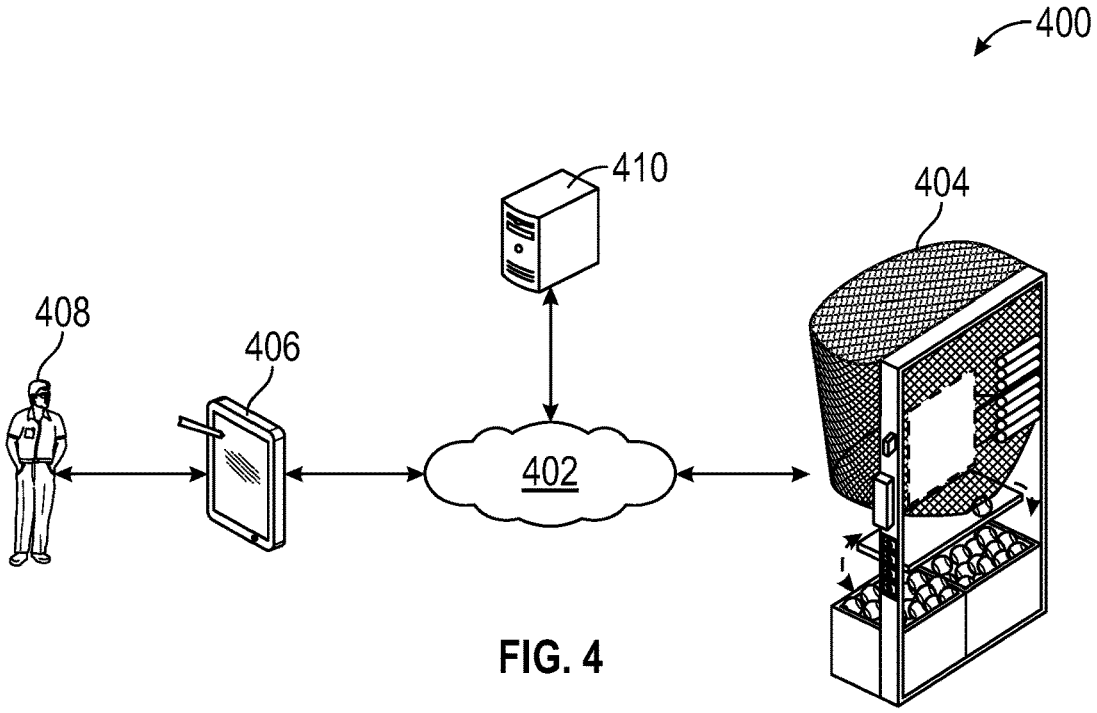
FIG. 4 illustrates a block diagram of an example high-level system architecture, in accordance with at least one embodiment of the disclosure.

FIG. 4 illustrates an example system 400 architecture in accordance with at least one embodiment of the disclosure. The system 400 may depict a more high-level system architecture than the systems 100, 200, and/or 300, and may depict elements that may interact with the systems 100, 200, and/or 300. In some embodiments, the system 400 includes one or more networks 402, a ball-sorting apparatus 404 (which may be the ball sorting apparatus depicted in FIGS. 1 and/or 2), a mobile device 406 that may be operable by a user 408, and a server 410. The system 400 may also include any of the other elements described with respect to FIG. 1-3 in addition to the ball-sorting apparatus 404, such as the ball-feeding mechanism (for example, ball-feeding mechanism 102 and/or any other ball-feeding mechanism described herein), the projection element (for example, projection element 104, as well as any other projection element described herein), or any other element described herein. Furthermore, any of the elements of the example system 400 (for example, mobile device 406 and/or the server 410) may include any of the elements of the control system, such as one or more processors 142, memory 144, one or more input/output (I/O) interfaces 146, one or more network interfaces 148, and data storage 150.

Any of the ball-sorting apparatus 404, mobile device 406, and server 410 may be configured to communicate with each other and any other component of the system 400 via one or more networks 402. A network 402 may include, but is not limited to, any one or a combination of different types of suitable communications networks such as, for example, cable networks, public networks (e.g., the Internet), private networks, wireless networks, cellular networks, or any other suitable private and/or public networks. Further, the network 402 may have any suitable communication range associated therewith and may include, for example, global networks (e.g., the Internet), metropolitan area networks (MANs), wide area networks (WANs), local area networks (LANs), or personal area networks (PANs). In addition, the network 402 may include any type of medium over which network traffic may be carried including, but not limited to, coaxial cable, twisted-pair wire, optical fiber, a hybrid fiber coaxial (HFC) medium, microwave terrestrial transceivers, radio frequency communication mediums, satellite communication mediums, or any combination thereof.

The mobile device 406 may be operable to provide inputs to the ball-sorting apparatus 106. For example, the user 408 may be able to manually input an ambient temperature instead of the second-type sensors determining the ambient temperature (or any of the other parameters described with reference to at least FIGS. 1A-1C, such as pressure or humidity). The mobile device 406 may also provide any other instructions relevant to the operation of the ball-sorting apparatus 106, the ball-feeding mechanism 102, and/or the projection element 104. The mobile device may also be able to perform any of the operations of the ball-sorting apparatus (e.g., the operations performed by the control system 140 of the ball sorting-apparatus with reference to FIG. 1). The server may be in the form of a remote cloud platform, for example.

The server 410 may serve as a remote platform for performing any of the operations of the ball-sorting apparatus (e.g., the operations performed by the control system 140 of the ball sorting-apparatus with reference to FIG. 1), as well as any of the other elements described with respect to systems 100, 200, and/or 300. The server 410 may also provide similar functionality of the mobile device 406 as well.

Example Methods

Figure 5:
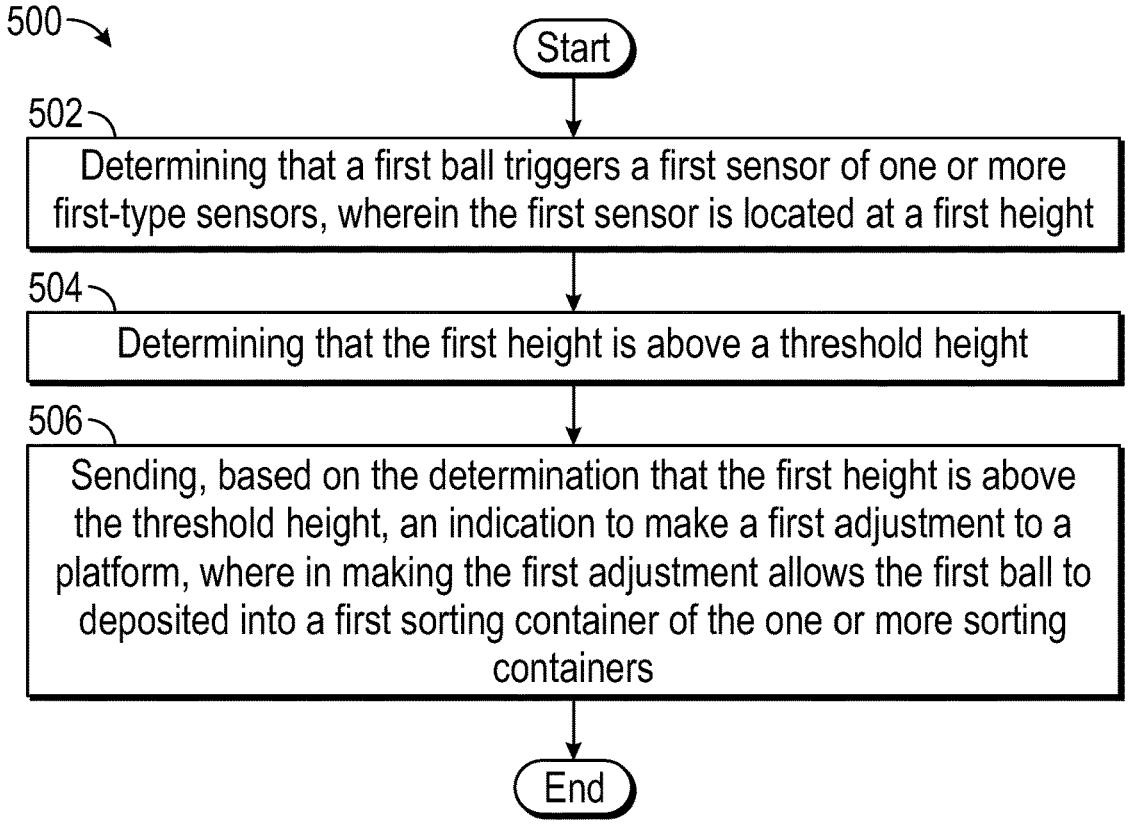
FIG. 5 illustrates a flow chart of an example flow diagram of an example process, in accordance with at least one embodiment of the disclosure.

FIG. 5 is a flowchart of an example method 500 of the present disclosure. In some embodiments, the method 500 may include an operation 502 of determining that a first sensor of one or more first-type sensors of a ball-sorting apparatus is triggered by a first ball passing by the first sensor, wherein the first sensor of the ball-sorting apparatus is located at a first height. In some embodiments, the method 500 may include an operation 504 of determining that the first height is above a threshold height. In some embodiments, the method may include an operation 506 of sending, based on the determination that the first height is above the threshold height, an indication to make a first adjustment to a sorting element of the ball-sorting apparatus, wherein making the first adjustment to the sorting element causes the sorting element to deposit the first ball in a first sorting container.

The disclosure is described above with reference to block and flow diagrams of systems, methods, apparatuses, and/or computer program products according to example embodiments of the disclosure. It will be understood that one or more blocks of the block diagrams and flow diagrams, and combinations of blocks in the block diagrams and the flow diagrams, respectively, can be implemented by computer-readable program instructions. Likewise, some blocks of the block diagrams and flow diagrams may not necessarily need to be performed in the order presented, or may not necessarily need to be performed at all, according to some embodiments of the invention.

Various block and/or flow diagrams of systems, methods, apparatus, and/or computer program products according to example embodiments of the disclosure are described above. It will be understood that one or more blocks of the block diagrams and flow diagrams, and combinations of blocks in the block diagrams and flow diagrams, respectively, can be implemented by computer-readable program instructions. Likewise, some blocks of the block diagrams and flow diagrams may not necessarily need to be performed in the order presented, or may not necessarily need to be performed at all, according to some embodiments of the disclosure.

These computer-executable program instructions may be loaded onto a special purpose computer or other particular machine, a processor, or other programmable data processing apparatus to produce a particular machine, such that the instructions that execute on the computer, processor, or other programmable data processing apparatus create means for implementing one or more functions specified in the flow diagram block or blocks. These computer program instructions may also be stored in a computer-readable memory that can direct a computer or other programmable data processing apparatus to function in a particular manner, such that the instructions stored in the computer-readable memory produce an article of manufacture including instruction means that implement one or more functions specified in the flow diagram block or blocks. As an example, embodiments of the disclosure may provide for a computer program product, comprising a computer-usable medium having a computer-readable program code or program instructions embodied therein, said computer-readable program code adapted to be executed to implement one or more functions specified in the flow diagram block or blocks. The computer program instructions may also be loaded onto a computer or other programmable data processing apparatus to cause a series of operational elements or operations to be performed on the computer or other programmable apparatus to produce a computer-implemented process such that the instructions that execute on the computer or other programmable apparatus provide elements or steps for implementing the functions specified in the flow diagram block or blocks.

Accordingly, blocks of the block diagrams and flow diagrams support combinations of means for performing the specified functions, combinations of elements or operations for performing the specified functions and program instruction means for performing the specified functions. It will also be understood that each block of the block diagrams and flow diagrams, and combinations of blocks in the block diagrams and flow diagrams, can be implemented by special purpose, hardware-based computer systems that perform the specified functions, elements or operations, or combinations of special purpose hardware and computer instructions.

Many modifications and other embodiments of the disclosure set forth herein will be apparent having the benefit of the teachings presented in the foregoing descriptions and the associated drawings. Therefore, it is to be understood that the disclosure is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A system for sorting balls, the system comprising:

a ball-feeding mechanism for receiving a first ball, wherein the ball-feeding mechanism comprises a feeding portion at an end of the ball-feeding mechanism, the feeding portion comprising one or more horizontally-oriented and movable slats;

a projection element comprising an angled surface, wherein the projection element is located below the feeding portion, and wherein the projection element receives the first ball on the angled surface from the feeding portion;

one or more sorting containers that are separate from the projection element, wherein the one or more sorting containers receive the first ball after it is projected from the angled surface of the projection element;

a sorting element configured to receive the first ball;

at least one processor; and at least one memory storing computer-executable instructions, that when executed by the at least one processor, cause the at least one processor to:

determine that a first sensor of one or more first-type sensors is triggered instead of a second sensor by the first ball passing by the first sensor at a first time, wherein the first sensor is located at a first height;

determine that the first height is above a threshold height;

send, based on the determination that the first height is above the threshold height, an indication to make a first adjustment to the sorting element, wherein making the first adjustment to the sorting element causes the sorting element to deposit the first ball in a first sorting container;

determine that a second sensor of the one or more first-type sensors is triggered, wherein the second sensor is located at a second height;

determine that the second height is below the threshold height; and send, based on the determination that the second sensor is triggered and the determination that the second height is below the threshold height, an indication to make a second adjustment to the sorting element, wherein making the second adjustment causes the sorting element to deposit the first ball in a second sorting container.

2. The system of claim 1, wherein the sorting element is a tilt table, wherein making the first adjustment to the sorting element comprises actuating the tilt table in a first direction, and wherein the first direction is in a direction of the first sorting container, and wherein making the second adjustment to the sorting element comprises actuating the tilt table in a second direction.

3. The system of claim 1, further comprising:

one or more second-type sensors, wherein the computer-executable instructions further cause the at least one processor to:

determine, based on the one or more second-type sensors, data, the data including at least one of: an ambient temperature, a humidity, or an atmospheric pressure; and adjust, based on the data, the threshold height.

4. An apparatus for sorting balls, the apparatus comprising:

one or more first-type sensors;

a sorting element configured to receive a first ball;

at least one processor; and at least one memory storing computer-executable instructions, that when executed by the at least one processor, cause the at least one processor to:

determine that a first sensor of the one or more first-type sensors is triggered by the first ball passing by the first sensor, wherein the first sensor is located at a first height, wherein the first ball is received from a projection element, wherein the projection element receives the first ball from a ball-feeding mechanism, wherein the projection element is located below the ball-feeding mechanism, wherein the ball-feeding mechanism further comprises a feeding portion at an end of the ball-feeding mechanism, the feeding portion comprising one or more horizontally-oriented and movable slats;

determine that the first height is above a threshold height;

send, based on the determination that the first height is above the threshold height, an indication to make a first adjustment to the sorting element, wherein making the first adjustment to the sorting element causes the sorting element to deposit the first ball in a first sorting container;

determine that a second sensor of the one or more first-type sensors is triggered, wherein the second sensor is located at a second height;

determine that the second height is below the threshold height; and send, based on the determination that the second sensor is triggered and the determination that the second height is below the threshold height, an indication to make a second adjustment to the sorting element, wherein making the second adjustment causes the sorting element to deposit the first ball in a second sorting container.

5. The apparatus of claim 4, wherein the sorting element is a tilt table, wherein making the first adjustment to the sorting element comprises actuating the tilt table in a first direction, and wherein the first direction is in a direction of the first sorting container.

6. The apparatus of claim 4, further comprising:

one or more second-type sensors, wherein the computer-executable instructions further cause the at least one processor to:

determine, based on the one or more second-type sensors, data, the data including at least one of: an ambient temperature, a humidity, or an atmospheric pressure; and adjust, based on the data, the threshold height.

7. A computer-implemented method comprising:

determining that a first sensor of one or more first-type sensors of a ball-sorting apparatus is triggered by a first ball passing by the first sensor, wherein the first sensor of the ball-sorting apparatus is located at a first height, wherein the first ball is projected from a projection element, wherein the projection element receives the first ball from a ball-feeding mechanism, wherein the projection element is located below the ball-feeding mechanism, and wherein the ball-feeding mechanism further comprises a ball management apparatus configured to control a rate at which the first ball and a second ball are received by the projection element, wherein the ball management apparatus comprises a first member and a second member that form a V-shaped mechanism, wherein the V-shaped mechanism is configured to rotate to a first position in which the first member is parallel with the ball management apparatus to allow the V-shaped mechanism to receive the first ball, wherein the V-shaped mechanism is configured to rotate to a second position in which the second member is parallel with the ball management apparatus to allow the V-shaped mechanism to provide the first ball to a feeding portion at an end of the ball management apparatus;

determining that the first height is above a threshold height; and sending, based on the determination that the first height is above the threshold height, an indication to make a first adjustment to a sorting element of the ball-sorting apparatus, wherein making the first adjustment to the sorting element causes the sorting element to deposit the first ball in a first sorting container;

determining that a second sensor of the one or more first-type sensors is triggered, wherein the second sensor is located at a second height;

determining that the second height is below the threshold height; and sending, based on the determination that the second sensor is triggered and the determination that the second height is below the threshold height, an indication to make a second adjustment to the sorting element, wherein making the second adjustment causes the sorting element to deposit the first ball in a second sorting container.

8. The computer-implemented method of claim 7, wherein the sorting element is a tilt table, wherein making the first adjustment to the sorting element comprises actuating the tilt table in a first direction, and wherein the first direction is in a direction of the first sorting container.

9. The computer-implemented method of claim 7, further comprising:

determining that a second sensor of the one or more first-type sensors is triggered, wherein the second sensor is located at a second height;

determining that the second height is below the threshold height; and sending, based on the determination that the second sensor is triggered and the determination that the second height is below the threshold height, an indication to make a second adjustment to the sorting element, wherein making the second adjustment causes the sorting element to deposit the first ball in a second sorting container.

10. The computer-implemented method of claim 7, further comprising:

determine, based on one or more second-type sensors, data, the data including at least one of: an ambient temperature, a humidity, or an atmospheric pressure; and adjust, based on the data, the threshold height.

11. The system of claim 1, wherein the ball-feeding mechanism further comprises: a ball management apparatus configured to control a rate at which the first ball and a second ball are received by the projection element, wherein the ball management apparatus comprises at least one of: a first member and a second member that form a V-shaped mechanism or a paddle wheel.

12. The method of claim 7, wherein the ball-feeding mechanism further comprises: a ball management apparatus configured to control a rate at which the first ball and a second ball are received by the projection element, wherein the ball management apparatus comprises at least one of: a first member and a second member that form a V-shaped mechanism or a paddle wheel.

13. The method of claim 7, wherein the ball-feeding mechanism further comprises a feeding portion at an end of the ball-feeding mechanism, the feeding portion comprising at least one of: a trap door configured to be actuated by a motor or servo, one or more movable slats, and/or a rotating plate comprising one or more holes.

14. The system of claim 1, wherein the feeding portion comprises two horizontally-oriented movable slats.

* * * * *